United States Patent [19]

Horeth

[11] 3,971,429

[45] July 27, 1976

[54] PROCESS OF EXTRACTING A HOT SLAB FROM A CONTINUOUS CASTING MOULD AND AN APPARATUS THEREFOR

[75] Inventor: Mathias Horeth, Linz, Austria

[73] Assignee: Vereinigte Osterreichische Eisen- und Stahlwerke-Alpine Montan Aktiengesellschaft, Linz, Austria

[22] Filed: July 31, 1975

[21] Appl. No.: 600,812

[30] Foreign Application Priority Data

Aug. 27, 1974 Austria ..... 6913/74

[52] U.S. Cl. ..... 164/82; 164/274

[51] Int. Cl.[2] ..... B22D 11/08

[58] Field of Search ..... 164/274, 273 R, 282, 164/82

[56] References Cited

UNITED STATES PATENTS

| | | | |
|---|---|---|---|
| 3,610,321 | 10/1971 | Khimich et al. | 164/274 |
| 3,717,198 | 2/1973 | Marti et al. | 164/274 |
| 3,774,671 | 11/1973 | Rossi | 164/274 |
| 3,814,169 | 6/1974 | Knell et al. | 164/274 |
| 3,861,451 | 1/1975 | Bauer et al. | 164/82 |

FOREIGN PATENTS OR APPLICATIONS

| | | | |
|---|---|---|---|
| 945,970 | 1/1964 | United Kingdom | 164/274 |

*Primary Examiner*—Leonidas Vlachos
*Attorney, Agent, or Firm*—Brumbaugh, Graves, Donohue & Raymond

[57] ABSTRACT

A process and an apparatus for extracting a hot strand from a continuous casting mould uses a tong-shaped starter bar head inserted into the lower opening of the mould which defines an upwardly open cavity filled with molten metal which is to solidify therein. The starter bar head is extracted and the nippers of the tongs are opened to detach themselves from the cast connection piece which is integral with the strand. Preferably the bit of the tongs is pretreated with a graphite size before the starter bar head is introduced into the mould.

6 Claims, 5 Drawing Figures

PROCESS OF EXTRACTING A HOT SLAB FROM A CONTINUOUS CASTING MOULD AND AN APPARATUS THEREFOR

BACKGROUND OF THE INVENTION

The invention relates to a process of extracting the hot strand from a continuous casting mould, wherein a starter bar head in the form of tongs is inserted; into the lower opening of the mould, thereby closing the lower opening, and is connected to a starter bar or an articulated starter bar (chain) as well as to an apparatus for carrying out this process.

Starter bar heads, in particular starter bar heads for wide slabs, which are connected to rails transverse to the longitudinal axis of the strand and are introduced into the lower opening of the mould in order to form a force-locking connection with the hot strand, have been known. This kind of connection has, however, the disadvantage that the preparation of the starter bar head by cutting the rails as well as packing and sealing the rails requires a lot of time and material.

Furthermore hook-shaped starter bar heads have been known which are introduced into the lower opening of the mould and fill the cross-section of the mould. When the molten metal poured into the mould has solidified, a counter hook forms which serves as a force-locking connection with the hook-shaped starter bar head. After the extraction, the starter bar head must, however, be separated from the hot strand by a turning or tilting movement, a separate actuating means being necessary therefor. This constitutes an additional constructional burden and — depending on the overall construction of the plant — cannot easily be accommodated.

Finally a tong-shaped starter bar head, whose nippers in their closed position embrace a rail piece, has become known. After the introduction of the tong-head into the mould opening, the rail is cast around it and thus a force-locking connection is produced. The nippers of the tongs are retained closed and in their open positions by a locking mechanism consisting of arresting cams and a rotating wedge, so that manual opening and closing manipulations are necessary.

SUMMARY OF THE INVENTION

The object of the invention is (a) to overcome the disadvantages of the known starter bar heads and the ways in which these starter bar heads have to be handled, (b) to create a process for extracting a hot strand from a continuous casting mould and a starter bar head therefor which enable a quick and simple connection of the starter bar head with the hot strand without the use of special cast pieces, (c) to guarantee an automatic separation of the starter bar head from the hot strand without requiring tilting or pivotal movements and without having to open by hand a locking mechanism such as bars, wedges etc., and (d) to generally improve the working safety. In a process of the above defined kind this object is achieved in that the bit of the tongs in the closed position of the nippers is cast full with molten metal and the starter bar head is extracted after the former has solidified, whereupon the nippers of the tongs are opened so as to detach them from the cast connection piece.

Suitably the bit of the tongs is pre-treated with a graphite size before the tongs are introduced into the mould, in order to prevent a welding together of the tongs and the strand, and scrap for cooling the molten metal flowing into the mould is introduced into the bit, so that the metal solidifies quickly.

The invention further comprises an apparatus for carrying out this process with a tong-shaped starter bar head filling the cross-section of the mould, wherein the nippers of the tongs in their closed position define an upwardly open cavity. The head is also characterised in that the legs of the tongs are connected via a shear-like linkage with two connecting brackets which are pivotable in direction from and to the strand axis. With this starter bar or articulated starter bar, the straddling and closing movements of the connecting brackets and the movement, in the same direction, of the nippers of the tongs, are forceably guided in arcuately extending rails.

According to a preferred embodiment, on the connecting brackets there are provided uncoupling pins which engage in U-section-shaped recesses in the rails.

Advantageously, the nippers of the tongs are kept in their closed position by a tension spring engaging at the shear-linkage, while the head of the tongs is introduced into the mould.

BRIEF DESCRIPTION OF THE DRAWINGS

In order that the invention may be more fully understood an embodiment of the process according to the invention and the starter bar head therefor shall now be described by way of an example and with reference to the accompanying drawings wherein.

DESCRIPTION OF AN EXEMPLARY EMBODIMENT

Figure 1:
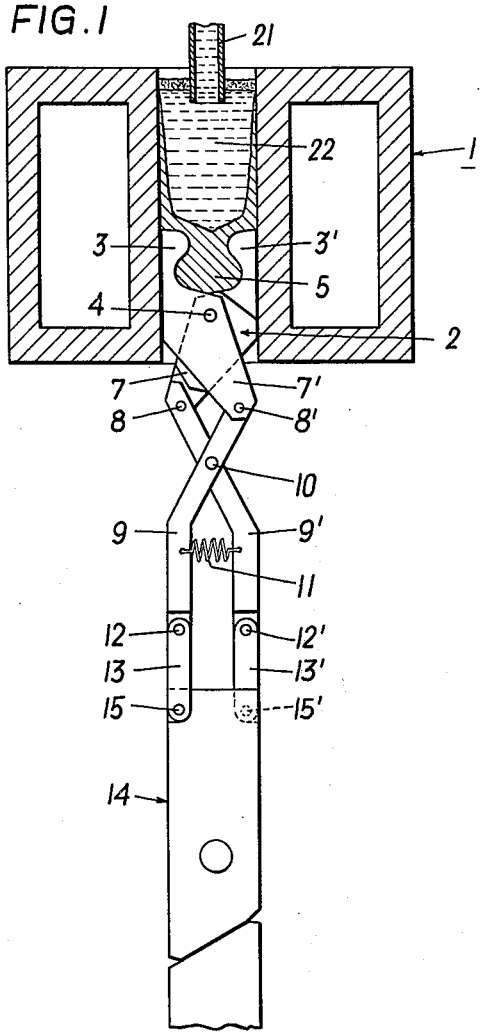
FIG. 1 shows the beginning of the casting, wherein the starter bar head is introduced in the lower opening of the mould, in side view.
Figure 3:
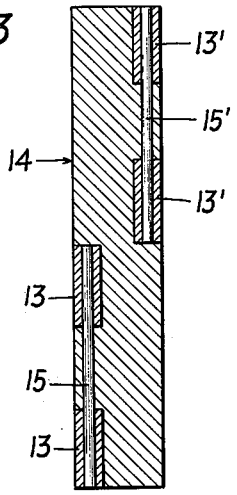
FIG. 3 is a section along line III—III of FIG. 2.

In FIG. 1 a continuous casting mould is denoted with 1. Into the lower opening of the mould a tong-shaped starter bar head 2 has been introduced and it fills the cross-section of the mould. The starter bar head has two tong-nippers 3 and 3', which are pivotable around a hinge pin 4. In the closed position shown in FIG. 1, the nippers of the tongs define an upwardly open cavity 5, the so-called bit of the tongs. The legs 7 and 7' of the tongs are hingedly connected with a shear-like linkage 9 and 9' via hinge pins 8 and 8', and the hinge of the shears is denoted with 10. A tension spring 11 pulls the shears, and thus also the nippers of the tongs, into the closed position while the starter bar head is introduced into the interior of the mould. The shear-linkage (9 and 9') is connected with the connecting brackets 13 and 13' via hinge pins 12 and 12', and the former are hingedly connected with the starter bar or the articulated starter bar 14 by means of hinge pins 15 and 15'. Because of the above described configuration of the shearlike linkage and the hinge-connections of the brackets 13 and 13', the latter can swing around the hinge pins 15 and 15' away from the longitudinal axis of the strand, thus causing the uncoupling of the tongs in a manner that will be described later on. As can be seen from FIG. 3, these brackets (13 and 13') are arranged at opposite sides of the starter bar 14, offset relative to each other, and each one extends over half of the bar width.

Figure 2:
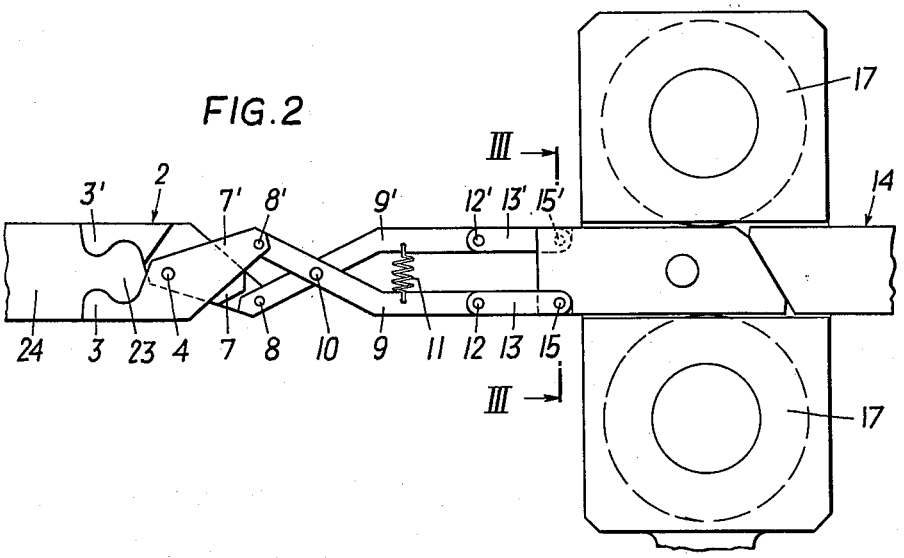
FIG. 2 shows the position in which the starter bar has been extracted on an arcuate guiding path (not shown), before the starter bar head reaches the extracting means.
Figure 4:
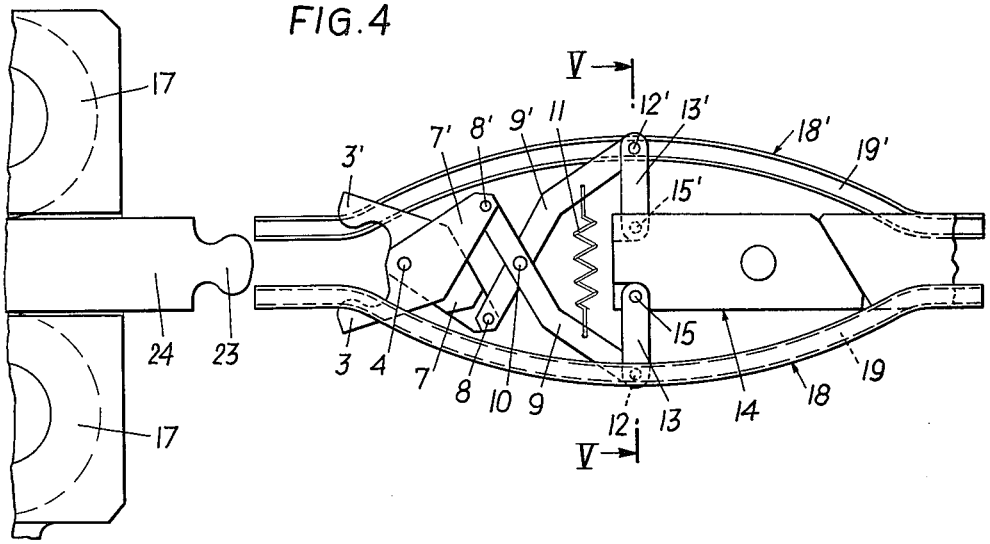
FIG. 4 shows the position after the starter bar head has left the extracting means and has entered the uncoupling means in which the nippers of the tongs are opened, again in side view.
Figure 5:
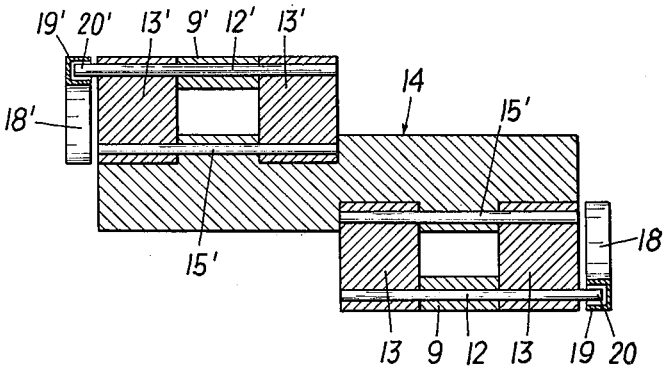
FIG. 5 is a section along the line V—V of FIG. 4.

The uncoupling means according to the invention is arranged shortly behind the drive rolling stand 17 of FIGS. 2 and 4 which acts as an extracting means. It consists of arc-shaped rails 18 and 18' (FIG. 4) arranged at both sides of the strand. These rails have U-section-shaped recesses 19 and 19'. The pins 12 and 12' on the connecting brackets 13 and 13', respectively, have protruding uncoupling extensions 20 and 20' which engage in the U-section-shaped recesses of the rails and thus are forceably guided by the rails. (FIG. 5)

The principle of operation according to the invention consists in that before the starter bar head is introduced into the lower opening of the mould, the bit of the tongs and the nippers of the tongs are pre-treated with a graphite size, and scrap for cooling is introduced into the bit of the tongs. Then molten metal 22 is poured into the mould via the casting tube 21 (FIG. 1) and fills the bit of the tongs. Under the influence of the scrap for cooling, solidification occurs quickly, whereupon the casting procedure can be started by extracting the starter bar with the starter bar head. As soon as the starter bar head, maintained in the closed position, has left the drive rolling stand 17, the uncoupling pins 20 and 20' are caught by the rails, the connecting brackets 13 and 13' are swung away from the longitudinal axis of the strand into the position of FIGS. 4 and 5, and the nippers 3 and 3' of the tongs are opened against the effect of the spring 11. They are detached from the cast connection piece 23 which is integral with the cast strand 24. Then the starter bar is withdrawn on the rollers, wherein a further guiding of the pins 20 and 20' along the arcuate rails causes the closing of the shears and, in the same direction, of the tongs. Suitably here the withdrawal speed of the starter bar is raised relative to the casting speed, so that it is advanced relative to the cast strand. Then the starter bar can be lifted off the run-out roller table. After that the nippers of the tongs are again treated with a graphite size and prepared for the next casting.

What I claim is:

1. A process of extracting a hot slab from a continuous casting mould with a lower opening by means of a tong-shaped starter bar head connected to a starter bar, comprising the steps of:

inserting the tong-shaped starter bar head having nippers forming a bit into the lower opening of said mould and thereby closing it, filling the bit formed between said nippers in closed position with molten metal and allowing the molten metal to solidify, thus forming a cast connection piece, subsequently extracting said starter bar head, and opening the nippers of the tong-shaped starter bar head in a controlled manner so as to detach said nippers from said cast connection piece.

2. A process as set forth in claim 1, wherein the starter bar is an articulated starter bar.

3. A process as set forth in claim 1, wherein the bit of said tong-shaped starter bar head is pre-treated with a graphite size before it is inserted into the lower opening of said mould.

4. An apparatus for extracting a hot strand from a continuous casting mould comprising:

a starter bar, a tong-shaped starter bar head dimensioned to fill the mould cross-section when inserted therein, said tong-shaped starter bar head being composed of tong-nippers defining an upwardly open cavity in their closed position and of tong-legs, a shear-like linkage connected to the tong-legs, two connecting brackets pivotable to and from the axis of the strand and connecting the shear-like linkage with the starter bar, and arcuately extending rails forming forced guide means connected with the connecting brackets for producing straddling and closing movements of the connecting brackets and for an analogous movement of the tong-nippers.

5. An apparatus as set forth in claim 4, wherein said starter bar is an articulated starter bar.

6. An apparatus as set forth in claim 4, further comprising

U-section-shaped recesses in said arcuately extending rails, and uncoupling pins provided on said connecting brackets engaging in said U-section-shaped recesses.

* * * * *